United States Patent [19]

Shattuck

[11] 3,976,906

[45] Aug. 24, 1976

[54] PROGRAMMABLE CHARACTER DISPLAY MODULE

[75] Inventor: Ronald Corroalles Shattuck, Canoga Park, Calif.

[73] Assignee: Litton Systems, Inc., Beverly Hills, Calif.

[22] Filed: June 9, 1975

[21] Appl. No.: 585,204

[52] U.S. Cl. ..... 313/500; 174/52 PE; 313/511; 313/512

[51] Int. Cl.[2] ..... H01J 29/46

[58] Field of Search ..... 313/500, 511, 512; 174/52 PE; 317/101 CP, 101 F; 357/72

[56] References Cited

UNITED STATES PATENTS

| | | | |
|---|---|---|---|
| 2,222,788 | 11/1940 | Touceda et al. | 174/52 PE |
| 3,693,252 | 9/1972 | Robertson et al. | 174/52 PE |

*Primary Examiner*—Stanley T. Krawczewicz
*Attorney, Agent, or Firm*—Donald J. Ellingsberg; Walter R. Thiel; Norman E. Brunell

[57] ABSTRACT

A programmable character display module for the lighted display of changeable indicia, where the display can have particular use in a switch assembly.

17 Claims, 5 Drawing Figures

PROGRAMMABLE CHARACTER DISPLAY MODULE

CROSS REFERENCE TO RELATED APPLICATION

Application by Ronald C. Shattuck, Ser. No. 585,203, filed June 9, 1975, even date herewith, for "SWITCH ASSEMBLY," and assigned to the assignee of the present application.

BACKGROUND OF THE INVENTION

Illuminated switch assemblies of various types are considered to be well known in the prior art. Among the various types are those switch assemblies that either project indicia from a plane behind the switch to the switch panel or from the plane behind the switch through the actual switch itself for viewing at the switch/switch panel assembly. U.S. Pat. No. 3,777,222 is considered to be one example of an indicating panel including a switch assembly that incorporates both principles of rear projection and through-the-switch illumination. However, where it is desired to use other than a membrane type switch (U.S. Pat. No. 3,732,389 is one example thereof) with the principle of through-the-switch illumination, a problem with switch actuation occurs since such actuation can require the displacement of a lighted display module which functions as the source of lighted indicia. The problem also occurs where the lighted display modules is the source of lighted and changeable indicia.

OBJECTS OF THE INVENTION

Accordingly, it is an object of the invention to provide a new and improved programmable character display module.

It is an object of the invention to provide a programmable character display module for illumination of changeable indicia.

It is an object of the invention to provide a programmable character display module for illumination of changeable indicia that minimizes damage to the lighted character display during use of the module in a switch assembly or the like.

SUMMARY OF THE INVENTION

Briefly, in accordance with the invention, a new and improved programmable character display module having a flexible substrate, a plurality of electrical conductors on the substrate, a character display on the substrate electrically connected to selected ones of the conductors, and an inflexible transparent material encapsulating both the character display and an adjoining portion of the substrate thereby converting the adjoining portion to an inflexible condition.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

DESCRIPTION OF THE INVENTION

Figure 1:
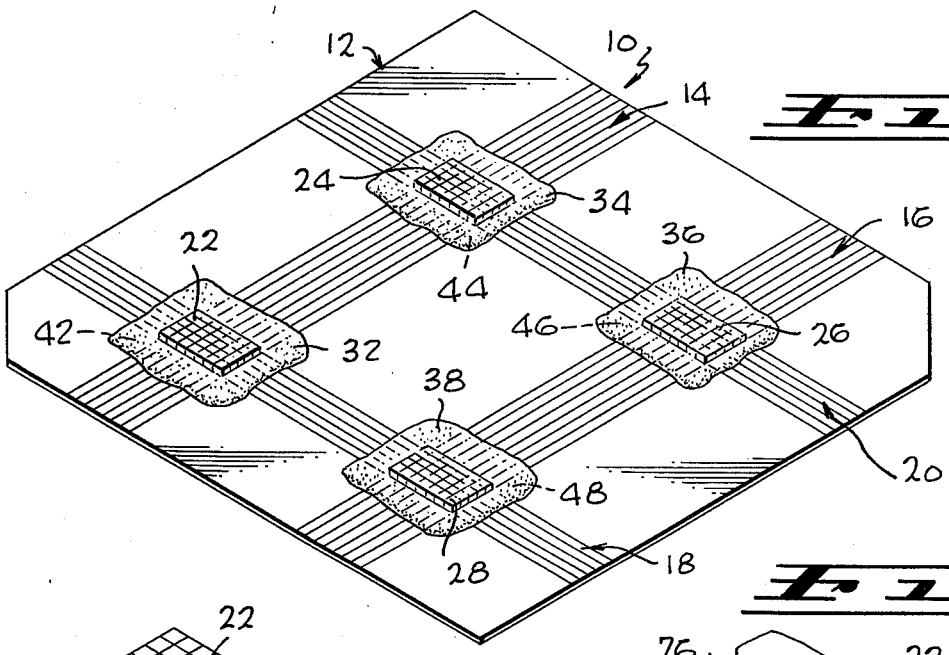
FIG. 1 is a perspective view of the programmable character display module of the invention.

Referring to FIG. 1, the programmable character display module 10 of the invention includes: a flexible substrate 12; a plurality of electrical conductors 14 and 16, which can be oriented along an x-axis of the substrate; a plurality of electrical conductors 18 and 20, which can be oriented along a y-axis of the substrate; a plurality of spaced apart character displays 22, 24, 26, and 28, which can be formed by separate light emitting diodes (LEDs) arranged in a 5 × 7 row-and-column character array as illustrated, that are electrically connected to selected ones of the x-axis electrical conductors and of the y-axis electrical conductors; and, inflexible transparent material 32, 34, 36, and 38, which can be a conventional epoxy flowed into position and suitably cured to its inflexible state, that encapsulates both the character displays and respective adjoining portions 42, 44, 46, and 48 of the substrate, which thereby converts the adjoining portions from the flexible state to the inflexible state so that any damage to the character displays by an applied force is substantially minimized or eliminated.

Figure 2:
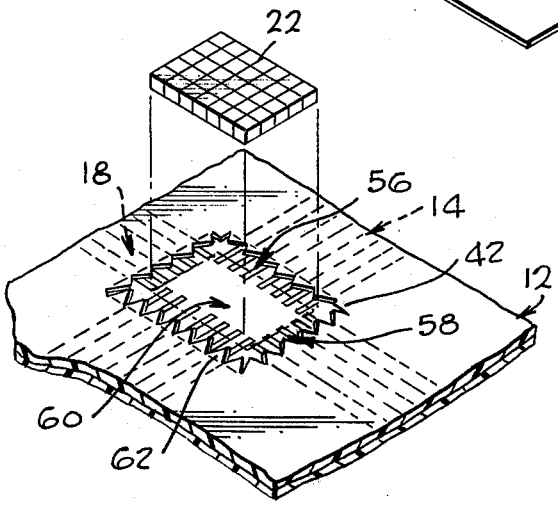
FIG. 2 is an enlarged, exploded, sectional view, partly broken away, of a portion of the programmable character display module of FIG. 1.
Figure 3:
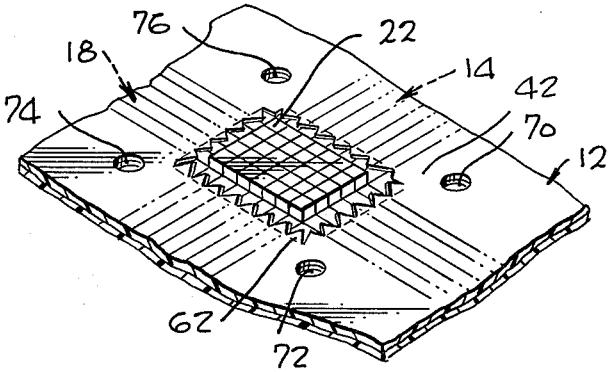
FIG. 3 is an enlarged perspective view, partly broken away, of the partially assembled portion of FIG. 2.
Figure 4:
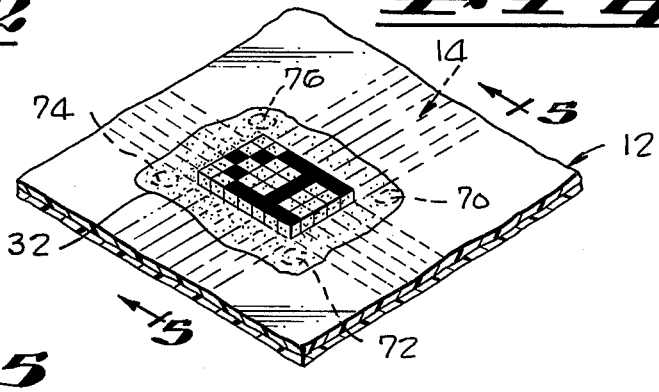
FIG. 4 is an enlarged perspective view, partly broken away, of the completely assembled portion of FIG. 2.

A portion of the programmable character display module 10 is shown by FIGS. 2 and 3 as an enlarged view for purposes of clarity of description and a better understanding of the invention.

The flexible substrate 12 has a base substrate sheet 50 and an overlay sheet 52 on the base sheet. The overlay sheet 52 is preferably bonded to the base sheet 50 which develops a flexible bonded joint 54 as more clearly shown by FIG. 5. The base sheet 50 can be a relatively thin, stable, dielectric and flexible sheet cut to a desired shape with the electrical conductors, such as conductors 14 and 18, positioned on the base sheet in a desired geometric layout; for example, the x- and y-axes layout as shown. The electrical conductors can be applied to the base sheet by any one of several conventional processes such as photo etch. In the programmable character display module 10 as shown by FIG. 2, the electrical conductors 14 and 18 terminate at a plurality of similar connector pads 56 and 58, respectively. The overlay sheet 52, which can have the same physical properties as the base sheet 50, has a plurality of display apertures like display aperture 60 as shown by FIGS. 2 and 3 selectively positioned in the overlay sheet to register with the connector pads, such as connector pads 56 and 58. The flexible substrate 12 is completed by bonding the overlay sheet 52 to the base sheet 50 as described hereinbefore. With the exception of the display apertures, such as aperture or window 60, the resulting bonded joint 54 (see FIG. 5) seals the flexible substrate either hermetically or otherwise as may be required for the end use of the display module 10.

Figure 5:
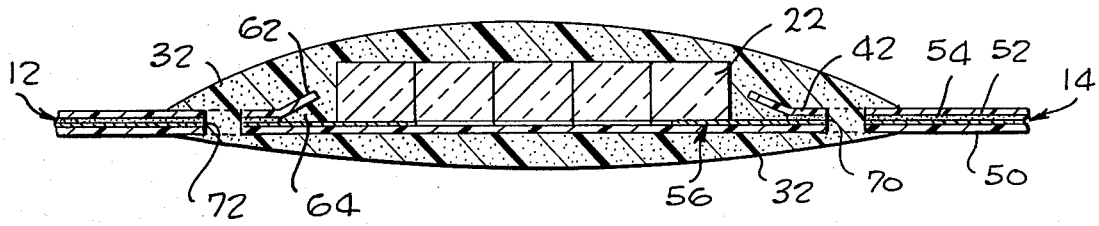
FIG. 5 is a sectional view, partly broken away, of the assembled portion of FIG. 4 along the line 5—5 thereof.

Referring to FIGS. 2, 3, and 5, the perimeter edge 62 of the display aperture 60 is not bonded to the base sheet 50 and is formed with an irregular contour. For example, the perimeter edge 62 is jagged and, as illustrated, can be serrated. The perimeter edge 62 of each display aperture, such as display aperture 60, in the overlay sheet 52 is bent away and spaced from the base sheet 50 to develop an angular relationship therebetween which is more clearly shown at 64 of FIG. 5. The desirable results obtained from the serrated perimeter edge 62 and its bent or angular relationship 64 are described hereinafter. As shown by FIG. 3, when the character display 22 is positioned within the display aperture 60 of the overlay sheet 52 and electrically connected to the selected connector pads 56 and 58 (see FIG. 2), the perimeter edge 62 encloses the character display interjacent the display and the adjoining portion 42 of the substrate 12.

Since the lighted character display 22 is relatively fragile, particularly when the display is an array of LEDs as shown by FIG. 3, the flexible substrate 12 is converted to an inflexible state at the display aperture 60 and its adjoining portion 42 by flowing the transparent material 32 over the array. The transparent material, which can be the conventional epoxy as described hereinbefore, flows over and under the perimeter edge 62 onto the adjoining portion 42 and under the perimeter edge into the angular volume 64 developed by the spaced-apart perimeter edge and the base sheet 50. A plurality of grip apertures 70, 72, 74, and 76, as shown by FIGS. 3 and 5, in the adjoining portion 42 permit the material 32 to flow from the obverse surface of the flexible substrate 12 to its reverse surface as clearly shown by FIG. 5. When the transparent material 32 cures to the rigid or inflexible state, it is securely locked to the flexible substrate 12 by the material within the grip apertures 70, 72, 74, and 76, and by the material engulfing not only the perimeter edge 62 but also the angular volume 64. The resulting inflexible, transparent material 32 encapsulates the character display 22, display aperture 60, perimeter edge 62, and adjoining portion 42; this protects the character display 22 from damage by any applied forces, and prevents loss of integrity in the electrical connections made between the character display and the connector pads 56 and 58 (see FIG. 2) which could result from the flexing thereof.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart from the true spirit and scope of the invention.

I claim:

1. A programmable character display module comprising:

a. a flexible substrate, b. a plurality of electrical conductor means on said substrate, c. character display means on said substrate electrically connected to selected ones of said conductor means, and d. an inflexible means encapsulating both said character display means and an adjoining portion of said substrate thereby converting said adjoining portion inflexible.

2. The programmable character display module of claim 1 in which said flexible substrate includes:

a. a base sheet, b. an overlay sheet, and c. at least one aperture in said overlay sheet exposing a selected portion of said conductor means for said electrical connection to said character display means, said aperture having a perimeter edge interjacent said display means and said adjoining portion enclosing said character display means.

3. The programmable character display module of claim 2 in which said at least one aperture is a plurality of apertures exposing selected portions of said conductor means.

4. The programmable character display module of claim 3 in which said electrical conductor means includes:

a. a plurality of spaced-apart first and second electrical conductors on said substrate, said first electrical conductors transverse to said second electrical conductors, and b. a plurality of conductor intersections developed by said transverse first and second electrical conductors, respective ones of said intersections being at associated ones of said apertures.

5. The programmable character display module of claim 2 in which said perimeter edge is spaced from said base sheet.

6. The programmable character display module of claim 2 in which said perimeter edge is jagged.

7. The programmable character display module of claim 6 in which said perimeter edge is serrated.

8. The programmable character display module of claim 1 in which said character display means is a light emitting character display.

9. The programmable character display module of claim 8 in which said light emitting character display is a light emitting diode array.

10. The programmable character display module of claim 1 in which said substrate adjoining portion includes at least one grip aperture so that said inflexible encapsulating means is fastened to said substrate.

11. The programmable character display module of claim 10 in which said at least one grip aperture is a plurality of grip apertures.

12. The programmable character display module of claim 2 in which said substrate adjoining portion includes a plurality of grip apertures spaced apart and from said perimeter edge so that said inflexible encapsulating means is fastened to said base sheet and said overlay sheet.

13. The programmable character display module of claim 12 in which said inflexible means is a clear encapsulant.

14. The programmable character display module of claim 13 in which said clear encapsulant is an epoxy.

15. The programmable character display module of claim 12 in which said overlay sheet is bonded to said base sheet.

16. A programmable character display module comprising:

a. a flexible substrate, b. a plurality of spaced-apart first and second electrical conductors on said substrate, said first electrical conductors transverse to said second electrical conductors, c. a plurality of electrical-conductor intersections developed by said transverse first and second electrical conductors, d. a flexible overlay on said substrate, e. a plurality of apertures in said overlay, each of said apertures having a perimeter edge enclosing a respective one of said plurality of electrical-conductor intersections thereby exposing said intersections, f. a light-emitting character display within each of said apertures electrically connected to said electrical conductors exposed thereby, and g. an inflexible means encapsulating said light-emitting character display and at least said perimeter edge associated with said display.

17. The programmable character display module of claim 16 in which said light-emitting character display is programmable through said electrical conductors.

* * * * *